United States Patent [19]

Rooney et al.

[11] Patent Number: 4,488,137

[45] Date of Patent: Dec. 11, 1984

[54] COMPOSITE FUSE LINKS EMPLOYING DISSIMILAR FUSIBLE ELEMENTS IN A SERIES

[75] Inventors: William J. Rooney, Clifton; Francis J. Rooney, Ramsey, both of N.J.

[73] Assignee: Commercial Enclosed Fuse Company, North Bergen, N.J.

[21] Appl. No.: 527,003

[22] Filed: Aug. 29, 1983

[51] Int. Cl.[3] ..... H01H 85/04; H01H 85/12

[52] U.S. Cl. ..... 337/162; 337/292

[58] Field of Search ..... 337/162, 164, 161, 160, 337/292, 296, 158, 159

[56] References Cited

U.S. PATENT DOCUMENTS 4,308,514 12/1981 Kozacka ..... 337/161

4,322,704 3/1982 Kozacka ..... 337/161

*Primary Examiner*—Harold Broome

*Attorney, Agent, or Firm*—Arthur L. Plevy

[57] ABSTRACT

A fuse link for use in a fast acting current limiting fuse also exhibiting a superior arc quenching capability consisting of a thin copper ribbon placed in series with a thin silver ribbon. The copper section provides a faster heating capability to the fuse while the silver section assures a lower arcing capability. The copper section has a series of apertures along the surface thereof which apertures are semicircular in configuration at the top and bottom of the copper section and separated by a circular aperture in between located in the center of the link. The silver section has top and bottom trapezoidal apertures which are separated by a smaller diameter circular aperture at the center of the link. The copper and silver links are placed in series between fuse terminals and are connected by both a mechanical and electrical connection to afford a reliable bond between the dissimilar metals constituting each of the separate links.

16 Claims, 5 Drawing Figures

COMPOSITE FUSE LINKS EMPLOYING DISSIMILAR FUSIBLE ELEMENTS IN A SERIES

BACKGROUND OF THE INVENTION

This invention relates to electrical fuses and more particularly to a composite fuse having two dissimilar fuse metals in series.

The prior art is replete with a host of patents describing various types of fuses for various purposes. As is well known, a fuse is an over current protective device with a circuit operating fusible part that is heated and severed by the passage of an over current through it. In regard to the structure of such fuses, they employ various types of fuse links. A fuse link may be a replaceable part or assembly which is comprised principally of a conducting element which element may be replaced after each circuit interruption to restore the fuse to the operating condition. The links of such fuses normally comprise a conductive metal, as for example copper, silver, aluminum, as well as other metals or various combinations or alloys of the above.

The prior art describes various materials which are employed in fuse links and specific assemblies of certain links as well as fuse constructions may be had by referring to U.S. Pat. No. 4,308,515 entitled FUSE APPARATUS FOR HIGH ELECTRIC CURRENTS, issued on Dec. 29, 1981 to W. J. Rooney, et al and assigned to the assignee herein.

As is well known, copper is a widely employed material which is used in many fuse links. Copper is a relatively good conductor, but as is understood, there are other elements which are better conductors. In regard to this silver is a better conductor than copper and the amount of energy required for heating silver is greater.

In regard to a link composed of silver one can usually provide a thinner link when employing silver than when employing copper for the same operating characteristics. When employing silver in a fuse, the formation of silver oxide enables such links to exhibit superior arc quenching capabilities during fuse operation. Essentially, when a fuse is severed, based on normal inductance in circuit operation, the current through the fuse is not interrupted instantaneously, and thus an arc is produced across the fuse elements. The fast interuption of such an arc may be damaging to the circuit components which are protected by a fuse.* In a fuse employing silver, the silver oxide formed acts to conduct the high voltage, and hence the arc is dissipated more rapidly than for example in a fuse employing a copper link.
because of the high voltages that can be produced by such actions.

On the other hand, copper has more resistance than silver for the same amount of material and a copper link would heat up faster. In regard to this heat the copper link stores more energy, and based on the heat, the copper link will sever more rapidly than a silver link but will produce greater arcing. It is, of course, a desire during fuse operation to produce a fuse which is capable of interrupting a short circuit current rapidly while producing a relatively low energy arc in order to further protect the circuit.

It is, therefore, an objective of the present invention to provide a composite fuse link employing a first section of copper and a second section of silver both of which are employed in series to enable the composite link to exhibit a rapid fuse operation with a low arcing capability.

BRIEF DESCRIPTION OF THE PREFERRED EMBODIMENT

A composite fuse link for use in a fuse and directed between a first fuse terminal and a second fuse terminal comprising a first planar section of a ribbon-like configuration fabricated from a first conductive material and having one end coupled to said first terminal and a second planar section of a ribbon-like configuration fabricated from a second conductive material being a better conductor than said first and having one end coupled to said other end of said first planar section and said other end coupled to said second terminal whereby said first and second planar sections are in series between said first and second terminals.

DETAILED DESCRIPTION OF THE FIGURES

Figure 1:
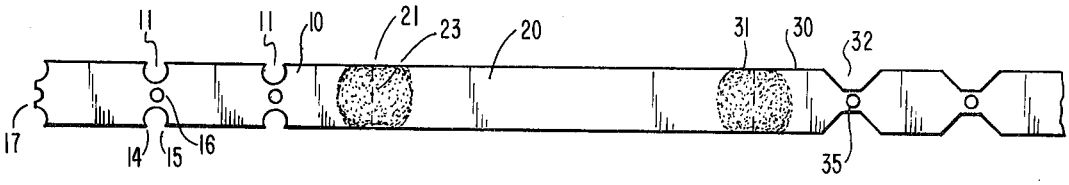
FIG. 1 is a top plan view of a composite fuse link according to this invention.

Referring to FIG. 1, there is shown a composite link according to this invention. The link shown in FIG. 1 has a first section 10 which is fabricated from a thin copper material and essentially is of a ribbon like construction. The section 10 has a series of apertures 11 on the surface thereof. The apertures as 11 essentially serve to reduce the cross section of the link section 10 at their location. The reduction in the cross section due to the apertures constitutes a weakening of the fuse link 10 at the reduced cross sectional points, and the metal located between the apertures is more prone to melt and cause current interruption during fuse operation. The use of the apertures as shown in FIG. 1 is employed in many fuse representations. As can be ascertained from FIG. 1, the top and bottom apertures constitute approximately $\frac{2}{3}$ of a complete circle whereby the tips or edges such as 14 and 15 as facing each other act as an arc gap which enables voltage arcs to jump across the tips, and hence the tips operate to broaden the voltage arc during fuse operation.

The top and bottom apertures of each reduced cross sectional area 11 are located between a central aperture 16 of a much smaller diameter. Thus, the link 10, as described above, is fabricated from a relatively thin sheet of copper and has the aperture configuration as shown in FIG. 1. One end 17 of the link 10 may be connected to a terminal pad or terminal end of a fuse while the other end of the link 10 is connected to a central copper bar 20. The copper bar 20 is fabricated from a thicker copper material than the link 10, and for example, the bar 20 may be two times as thick as the ribbon section 10. The end of the ribbon 10 is secured to the end of the bar 20 by means of both a mechanical and electrical connection.

Figure 2:
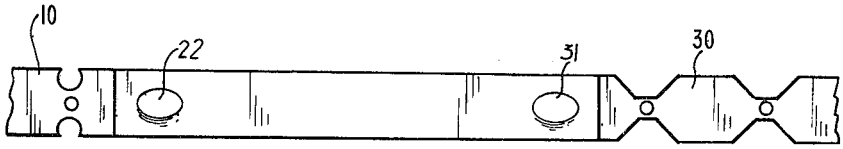
FIG. 2 is a bottom view of the fuse link of FIG. 1.

Essentially, as shown in FIG. 2, the mechanical connection 22 constitutes a staking technique. In this technique a suitable tool forces the thin copper foil 10 into the copper bar 20 as shown in FIG. 3A to produce a relatively good mechanical bond. Once the mechanical bond is provided, the area is coated with a good conducting solder such as a high temperature silver solder of the type containing about 5 percent silver. The central copper bar also serves as a link for the fuse and, based on its thickness and length, acts as part of the fuse link for the entire link assembly. Coupled to the other end of the copper bar 20 is an end link 30 which is fabricated from silver. The link 30 is also secured to the central copper bar 20 by means of a staking and solder connection 31. The silver link 30 has a series of trapezoidal cutouts 32 which also serve to reduce the cross sectional area of the silver link at the cutout points.

The cutouts or apertures on the silver link as indicated are not circular in shape but are trapezoidal with a top and bottom cutout being of a mirror image and separated one from the other by a circular aperture 35 of a smaller diameter than the aperture 16 in the copper link.

In regard to the fuse link shown in FIG. 1, it is seen that a first apertured ribbon section 10 consists of copper and is mechanically and electrically joined to a central section 20 which is a thick copper material which section 20 is both mechanically and electrically connected to an end section 30 fabricated from silver and having trapezoidal apertures along the surfaces thereof.

The link shown in FIG. 1 provides a faster heating fuse with a superior arc quenching capability. The silver link 30 operates to suppress arcs which are generated when the fuse opens based on a very low peak current as determined by the copper section 10.

As indicated above, the copper section 10 has a greater resistance than the central section 20 or the silver section 30 and, therefore, can be designed to enable the fuse to accommodate a low peak current due to the faster heating of the copper section. In any event, when the copper section 10 opens due to a over current, the arc which would be produced is rapidly quenched based on the operation of the silver section 30 including the trapezoidally shaped reduced cross sectional areas. Thus, the fuse shown in FIG. 1 exhibits a low arcing capability while enabling a fast current interruption due to the presence of both the copper and the silver section.

Figure 3:
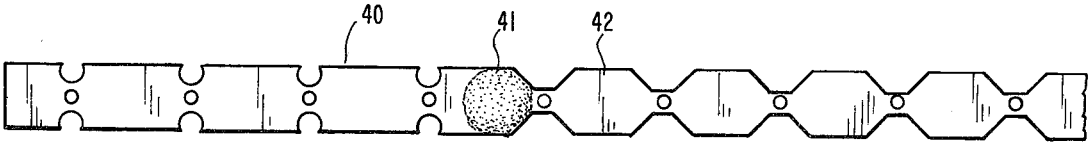
FIG. 3 is a top plan view of an alternate embodiment of a fuse link according to this invention.
Figure 3A:
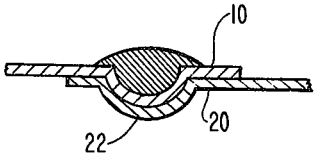
FIG. 3A is a side view depicting a typical mechanical and electrical connection employed in the fuse links.

Referring to FIG. 3, there is shown a first fuse section 40 which is fabricated from copper and is of a similar configuration to section 10 of FIG. 1. The section 40 is both mechanically and electrically coupled by a staking and soldering connection 41 to a silver link assembly 42 which is of a similar construction to link section 30 of FIG. 1. The fuse link of FIG. 3 does not have the large solid copper section 20 as shown in FIG. 1 but includes a thin ribbon copper section 40 electrically and mechanically coupled to a thin ribbon silver section 42.

Figure 4:
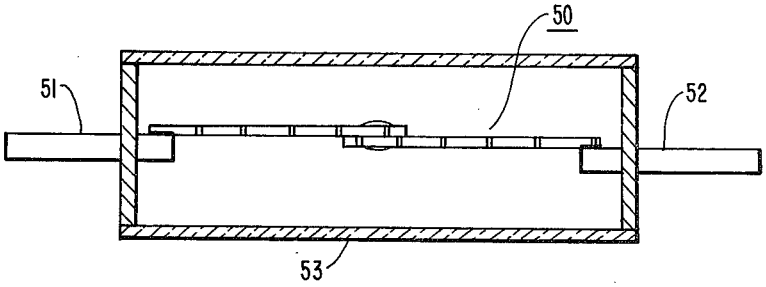
FIG. 4 is a partial cross sectional side view of a fuse assembly employing a link according to this invention.

Referring to FIG. 4, there is shown a cross sectional view of a fuse link 50 such as the link of FIG. 1 or FIG. 3 directed between an input terminal 51 and an output terminal 52 and arranged in a housing 53. It is, of course, understood that the housing 53 may be fabricated from many different materials such as glass, Kraft paper and various other insulating materials as such housings are well known in the art. It is understood that a major advantage of the above noted link configuration is to provide a fuse which exhibits a faster heating capability due to the presence of the copper while providing superior arc quenching capability due to the presence of the silver section. The exact operating characteristics of the fuse are not known but by emplacing the elements in series and connecting the elements with both a mechanical and electrical connection, the resultant fuse exhibits such superior operating conditions.

It is also noted that the improved operation in regard to the arc quenching capability of the fuse is also enhanced by utilizing circular apertures in the copper section and trapezoidal apertures in the silver section.

I claim:

1. A composite fuse link for use in a fuse and directed between a first fuse terminal and a second fuse terminal comprising:

a first planar section of a ribbon-like configuration fabricated from a first conductive material and having one end coupled to said first terminal and a second planar section of a ribbon-like configuration fabricated from a second conductive material being a better conductor than said first and having one end coupled to said other end of said first planar section and said other end coupled to said second terminal whereby said first and second planar sections are in series between said first and second terminals, wherein said one end of said second planar member is coupled to said one end of said first planar member by means of a mechanical and electrical bond, wherein said mechanical bond is a "staking" bond formed by indenting said first conductive material into said second conductive material wherein said electrical bond is a solder bond formed by covering said "staked" area with a silver based solder.

2. The composite fuse link according to claim 1, wherein said first planar section is fabricated from copper and said second section is fabricated from silver.

3. The composite fuse link according to claim 1, wherein said first planar section has a series of reduced cross sectional areas on a surface thereof which each area manifested by a top and bottom semicircular aperture one aperture located on one edge and the other at the other edge along the same axis with a smaller diameter circular aperture having its center at said axis and located between said semicircular apertures.

4. The composite fuse link according to claim 3, wherein said second planar section has a series of reduced cross sectional areas on a surface thereof with each area manifested by a top and bottom trapezoidal aperture, one aperture located on one edge and the other at the other edge and along the same axis, with a given diameter circular aperture having its center at said axis and located between said trapezoidal apertures.

5. The composite fuse link according to claim 4, wherein said given diameter of said circular aperture of said second planar member is less than the diameter of said circular aperture of said first planar member.

6. The composite fuse link according to claim 1, wherein said one end of said first section is coupled to said one end of said second section by means of a central conductive planar member.

7. The composite fuse link according to claim 6, wherein said central conductive planar member is fabricated from said first conductive material.

8. The composite fuse link according to claim 6, wherein said first planar section has one end mechanically and electrically coupled to one end of said central member with the other end of said central member mechanically and electrically coupled to said one end of said second planar section.

9. The composite fuse link according to claim 6, wherein said central conductive planar member is substantially thicker than said first and second sections.

10. The composite fuse link according to claim 7, wherein said central conductive member is fabricated from copper.

11. The composite fuse link according to claim 8, wherein said mechanical coupling of said ends to said central member is a staking bond formed by indenting said material of said planar sections into said material of said central member.

12. The composite fuse link according to claim 11, wherein said electrical coupling is a silver solder bond covering said staked areas and coupling said first and second planar sections to said central member.

13. The composite fuse link according to claim 12, wherein said silver solder contains at least 5 percent silver.

14. An electrical fuse, comprising:

a hollow housing having a first terminal end and a second terminal end for connecting said fuse in circuit, a fuse link connected between said terminal ends and within said housing, said link comprising a first planar section of a ribbon-like configuration fabricated from copper and having one end coupled to said first terminal end of said housing and a second planar section of ribbon-like configuration fabricated from silver and having one end coupled to said second terminal end and having the other end coupled to the other end of said first planar section whereby said first and second planar sections are in series between said first and second terminal ends with said first and and second planar sections having reduced cross sectional areas on the surface thereof, and spaced at predetermined intervals along said surfaces, wherein said first and second planar members are coupled together by means of a mechanical and electrical bond, wherein said mechanical bond is a "staking" bond formed by indenting said copper material into said silver material wherein said electrical bond is a solder bond formed by covering said "staked" area with a silver based solder.

15. The electrical fuse according to claim 14, wherein said first planar section has said reduced cross sectional areas manifested by first and second semicircular apertures located on the same axis and opened at opposite edges of said first planar section and with a central aperture therebetween.

16. The electrical fuse according to claim 14, wherein said second planar section has said reduced cross sectional areas manifested by first and second trapezoidal apertures located on the same axis and opened at opposite edges of said second planar section with a central aperture therebetween.

* * * * *